US005879225A

United States Patent [19]

Kudo et al.

[11] Patent Number: 5,879,225

[45] Date of Patent: Mar. 9, 1999

[54] POLISHING MACHINE

[75] Inventors: Michio Kudo; Yasuo Inada; Makoto Nakajima; Masanori Fukushima, all of Nagano, Japan

[73] Assignee: Fujikoshi Kikai Kogyo Kabushiki Kaisha, Nagano-Ken, Japan

[21] Appl. No.: 834,612

[22] Filed: Apr. 14, 1997

[30] Foreign Application Priority Data

Apr. 25, 1996 [JP] Japan ..... 8-104964

[51] Int. Cl.[6] ..... B24B 7/22

[52] U.S. Cl. ..... 451/271; 451/287

[58] Field of Search ..... 451/271, 270, 451/285, 287, 288, 357, 494

[56] References Cited

U.S. PATENT DOCUMENTS

| | | | |
|---|---|---|---|
| 449,686 | 4/1891 | Malevez | 451/270 |
| 513,618 | 1/1894 | Oppermann | 451/270 |
| 3,866,359 | 2/1975 | Kikuchi | 451/271 |

FOREIGN PATENT DOCUMENTS

| | | | |
|---|---|---|---|
| 475857 | 5/1929 | Germany | 451/271 |
| 441686 | 9/1949 | Italy | 451/271 |
| 1257778 | 11/1986 | Japan | 451/494 |

*Primary Examiner*—Robert A. Rose
*Attorney, Agent, or Firm*—Jordan and Hamburg LLP

[57] ABSTRACT

A polishing machine of the present invention is capable of uniformly polishing a member to be polished with high flatness, and polishing cloth, which is employed in the polishing machine, is uniformly abraded. In the polishing machine, a polishing plate is capable of rotating. A supporting table rotatably supports the polishing plate. A rotary driving mechanism is mounted on the supporting table, and it rotates the polishing plate. A base supports the supporting table. An orbital driving mechanism moves the supporting table along a circular orbit without spinning about its own axis.

6 Claims, 3 Drawing Sheets

POLISHING MACHINE

BACKGROUND OF THE INVENTION

The present invention relates to a polishing machine for polishing wafers, e.g., silicon wafers, glass wafers or.

Conventionally, a polishing machine for polishing the wafers basically has: a wafer holding section; a polishing plate for polishing the wafer, the polishing plate being arranged to face the wafer holding section; a mechanism for moving the wafer holding section close to and away from the polishing plate, so as to make the wafer contact a polishing face of the polishing plate; a pressing mechanism for pressing the wafer onto the polishing face with prescribed force; a driving mechanism for relatively moving the wafer, which has been pressed onto the polishing plate, with respect to the polishing plate by rotary movement and/or swing movement; and a mechanism for supplying a liquid abradant, e.g., slurry. Further, the polishing plate has a polishing member, e.g., cloth, felt, sponge, a short hair brush, which is provided on the polishing face of the polishing plate, which is made of a metal plate or a ceramic plate.

A surface of the wafer, e.g., a silicon wafer for semiconductor devices, or a thin glass plate, can be polished like a mirror face by the conventional polishing machine.

In the conventional polishing machine, the wafer which is pressed onto the polishing plate is moved relative to the polishing plate so as to polish the surface of the wafer. The polishing plate is not only rotated about its own axis but also is swung so as to uniformly abrade the polishing member, e.g., the polishing cloth.

However, by rotating or spinning the polishing plate about its own axis so as to polish the wafer, rotational speed at positions on the wafer is different. Namely, rotational speed at a position close to an outer edge of the wafer is faster than rotational speed at a position close to a center thereof. With the speed difference, the surface of the wafer cannot be polished uniformly. To uniformly polish the wafer, the polishing plate is swung but the swing movement is not executed smoothly. Namely, a speed of the swing movement must be changed at turning points, so the polishing plate is not moved at fixed speed throughout. Therefore, in the conventional polishing machine, flatness of the polished wafer is limited. Further, the polishing member is not abraded uniformly.

SUMMARY OF THE INVENTION

An object of the present invention is to provide a polishing machine which is capable of uniformly polishing a member to be polished with high flatness.

Another object of the present invention is to provide a polishing machine in which a polishing member, e.g., polishing cloth, is uniformly abraded.

To achieve the objects, the polishing machine of the present invention comprises:

- a polishing plate having a polishing face for polishing a surface of a wafer, the polishing plate being capable of rotating about an axis perpendicular to the polishing face;
- a supporting table supporting the polishing plate, which is capable of rotating thereon;
- a rotary driving mechanism being mounted on the supporting table, the rotary driving mechanism rotating the polishing plate;
- a base supporting the supporting table; and

- an orbital driving mechanism moving the supporting table, with respect to the base, along a circular orbit in a plane parallel to the polishing face without spinning about its own axis.

In the polishing machine, the orbital driving mechanism embodiment includes:

- at least three arms, each of which is formed into a crank shape including: a first shaft, which is rotatably provided to the base and which is capable of rotating about an axis parallel to the axis of the polishing plate; and a second shaft, which is rotatably provided to the supporting table with prescribed distance away from the first shaft and which is capable of rotating about an axis parallel to an axis of the first shaft; and
- means for synchronously rotating the arms.

The polishing machine may further comprise:

- a pressing mechanism holding the wafer and pressing the same onto the polishing face; and
- a rotating mechanism rotating the wafer, the rotating mechanism being provided to the pressing mechanism.

In the polishing machine, the rotary driving mechanism may include:

- a motor being fixed to the supporting table;
- a worm gear being fixed to an output shaft of the motor; and
- a worm wheel engaging with the worm gear.

In the polishing machine, the orbital driving mechanism may be motors, each of which corresponds to each of the arms, which are fixed to the base.

In the polishing machine, the polishing plate may be detachably attached to the rotary driving mechanism.

In the polishing machine, the polishing plate may be attached to the rotary driving mechanism by vacuum sucking.

In the polishing machine of the present invention, the polishing plate is moved by the combined movement of the spinning of the supporting table about its own axis and the circular orbital movement of the supporting table without spinning about its own axis. By the orbital movement, all points on the polishing plate move at the same speed, so all points on the surface of the wafer are uniformly polished. By uniformly polishing the wafer, the polishing member, e.g., the polishing cloth, is uniformly abraded, so wafers are polished under the same condition without adjusting the polishing condition, which is caused by uneven abrasion of the polishing member.

BRIEF DESCRIPTION OF THE DRAWINGS

An embodiment of the present invention will now be described by way of an example and with reference to the accompanying drawings, in which.

DETAILED DESCRIPTION OF THE INVENTION

A preferred embodiment of the present invention will now be described in detail with reference to the accompanying drawings.

Figure 1:
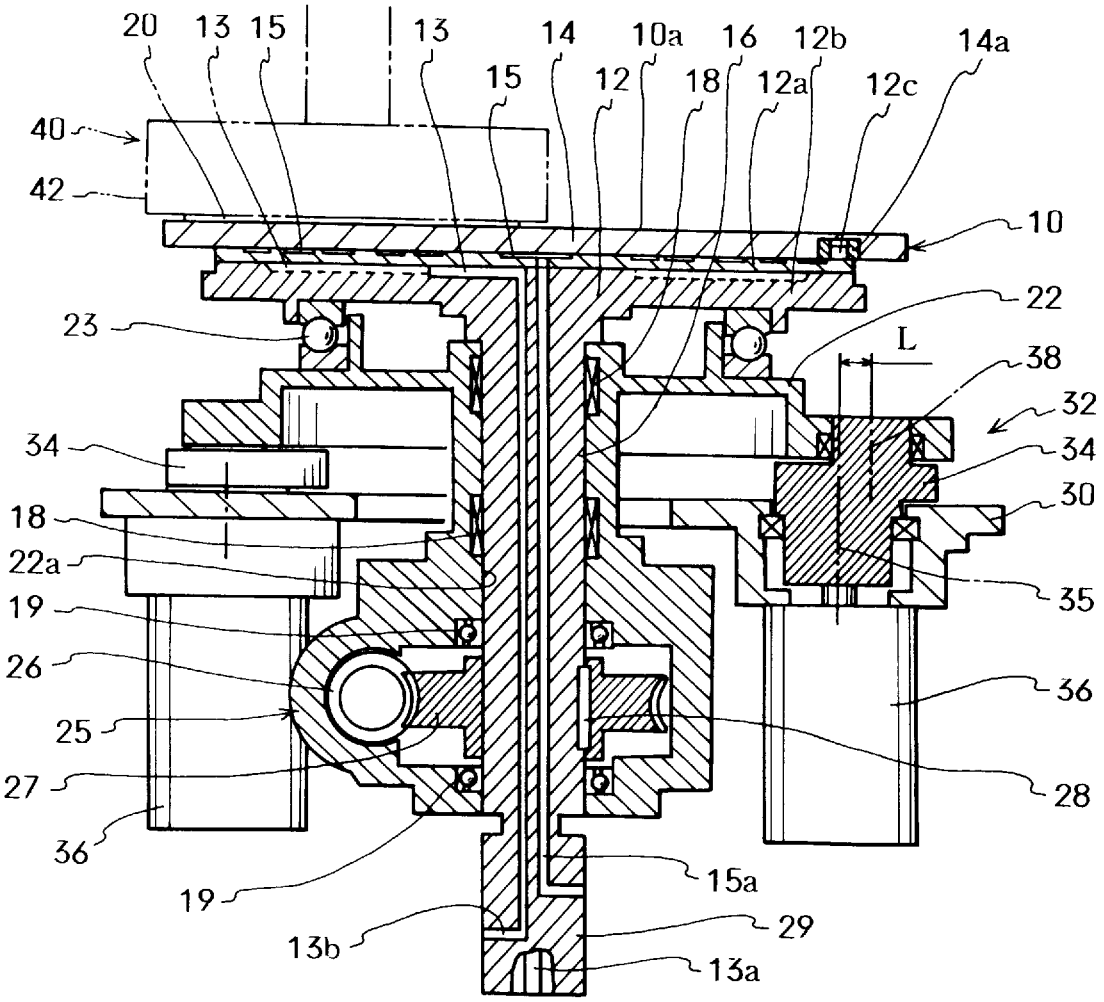
FIG. 1 is a sectional view of a polishing machine of an embodiment of the present invention.
Figure 2:
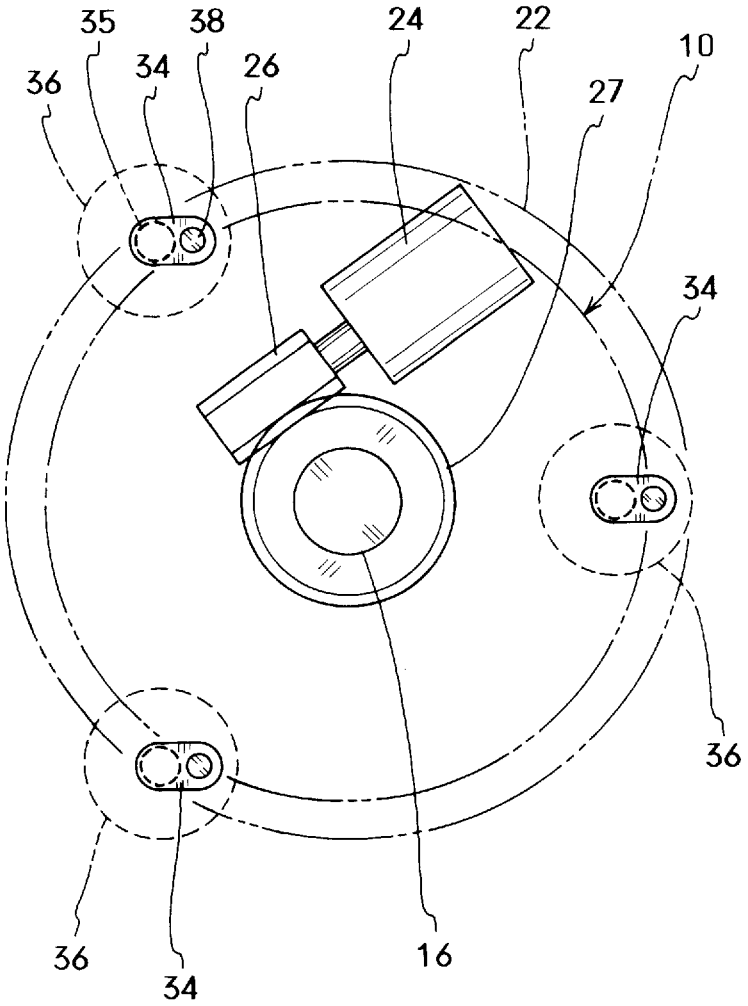
FIG. 2 is an schematic plan view of driving mechanisms.

In FIGS. 1 and 2, a surface of a wafer is pressed onto a polishing face 10*a* of a polishing plate 10 with a prescribed force and polished by moving the polishing plate 10 with respect to the wafer. A driving mechanism of the polishing machine is shown in FIGS. 1 and 2.

The polishing plate 10 includes a plate holder 12 and a plate proper 14, which is mounted on the plate holder 12. The plate proper 14 is held on the plate holder 12 by air suction, so that the plate proper 14 is easily attached to and detached from the plate holder 12. The plate proper 14 is made of a metal plate or a ceramic plate, on which a polishing member, e.g., polishing cloth, felt cloth, sponge, or a short hair brush are fixed. A shaft 16 is extended downward from the plate holder 12.

The plate holder 12 has two flat layers 12*a* and 12*b*. The flat layer 12*b* is integrated with the shaft 16. There is formed a water path 13, in which cooling water is circulated, between the flat layers 12*a* and 12*b*. The water path 13 for circulating the cooling water is connected with a water path 13*a* for introducing the cooling water and a water path 13*b* for discharging the cooling water. The water paths 13*a* and 13*b* are connected with a water supplying unit (not shown), so that the cooling water is circulated.

In an upper face of the flat layer 12*a* on which the plate proper 14 is mounted, vacuum air paths 15 are formed so as to suck and hold the plate proper 14. The vacuum air paths 15 are mutually connected and connected with a vacuum generator (not shown) via an air path 15*a*, which is formed in the shaft 16.

Pins 12*c* are projected upward from the flat layer 12*a* and are capable of fitting into holes 14*a* of the plate proper 14. By fitting the pins 12*c* in the holes 14*a*, a position of the plate proper 14 with respect to the plate holder 12 is defined.

A supporting table 22 rotatably supports the polishing plate 10, so the polishing plate 10 is capable of rotating or spinning about its own axis. The shaft 16 of the polishing plate 10 is inserted in a central through-hole 22*a* of the supporting table 22. The shaft 16 is supported and received by a thrust bearing 23 and radial bearings 18 and 19, so the polishing plate 10 is rotatble or spun with respect to the supporting table 22.

A rotary driving mechanism 25 is mounted on the supporting table 22. The rotary driving mechanism 25 rotates the polishing plate 10, about its own axis, with respect to the supporting table 22. In the present embodiment, for example, the rotary driving mechanism 25 includes: a motor 24 (see FIG. 2) fixed to the supporting table; a worm gear 26 fixed to an output shaft of the motor 24; and a worm wheel 27 engaging with the worm gear 26, the worm wheel 27 is fixed to the polishing plate 10. The worm wheel 27 is keyed with the shaft 16 by a key 28, so that the worm wheel 27 is rotated together with the shaft 16.

A distributing section 29 of the polishing plate 10 and a distributing section 92 of a pressing mechanism 40 (see FIG. 3) have the same structure. With the distributing section 29, the cooling water is introduced to and discharged from the water path 13 even when the shaft 16 is rotated; the air path 15 is connected with the vacuum generator even when the shaft 16 is rotated.

A base 30 supports the supporting table 22. The base 30 shown in FIG. 1 constitutes a part of a machine frame, and the base 30 is fixed to a main part of the machine frame by fixing members (not shown).

An orbital driving mechanism 32 moves the the supporting stable 22, with respect to the base, along a circular orbit in a plane parallel to the polishing face 10*a* of the polishing plate 10 without rotating (spinning) about its own axis. In the present embodiment, for example, the orbital driving mechanism 32 includes arms 34 and motors 36.

At least three arms 34 are provided between the base 30 and the supporting table 22 as shown in FIG. 2. Each arm 34 is formed into a crank shape including: a first shaft 35, which is rotatably supported by the base 30; and a second shaft 38, which is rotatably mounted in the supporting table 22 with a prescribed distance "L" away from the first shaft 35, the second shaft 38 is parallel to the first shaft 35. In the present embodiment, there are three arms 34 between the base 30 and the supporting table 22, but four or more arms 34 may be provided to stably support the supporting table 22.

The motors 36 for the orbital movement are capable of synchronously rotating the arms 34 so as to move the supporting table 22, with respect to the base 30, along the circular orbit without rotating its own axis. The motors 36 respectively rotate the arms 34, and they are fixed to the base 30.

Figure 3:
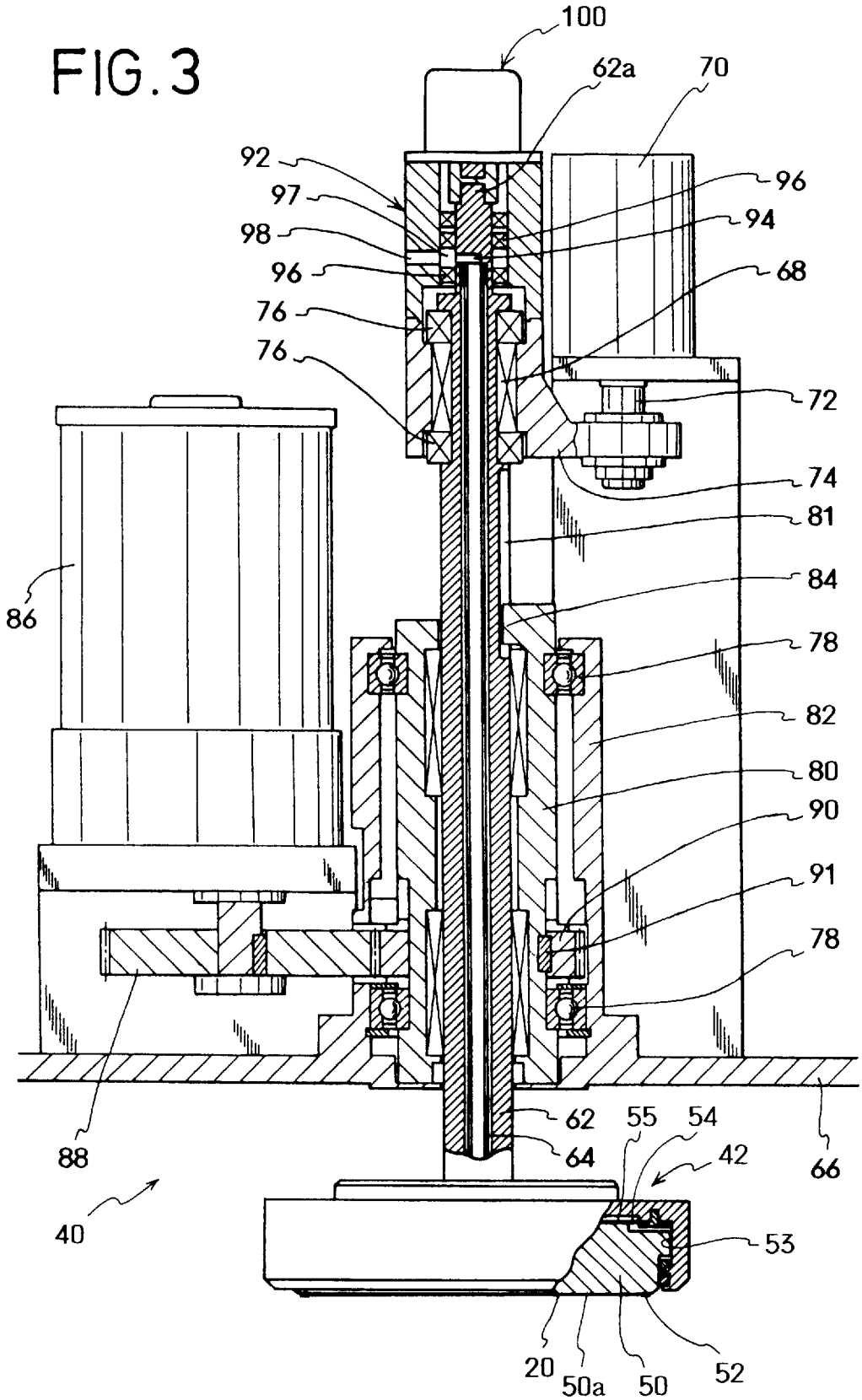
FIG. 3 is a sectional view of a pressing mechanism of the polishing machine.

Next, the pressing mechanism 40 will be explained with reference to FIG. 3.

The pressing mechanism 40 is provided above the polishing plate 10. The pressing mechanism 40 holds the wafer 20 to make a lower face of of the wafer 20 contact the polishing face 10*a* of the polishing plate 10 and presses the wafer 20 thereon.

A holding member 50 holds the wafer 20 on its bottom face 50*a* by surface tension of liquid, e.g., water. The holding member 50, made of a ceramic plate, on which an elastic member for tightly fitting on a rear face of the wafer 20 is adhered. For example, a fine porous sheet, which is made from high polymer mainly including polyurethane, can be employed as the elastic member. The elastic member is easily and tightly fit on the wafer 20 by its elasticity.

A template 52 is adhered on a bottom face of the holding member 50. The template 52 is formed into a ring shape to enclose the wafer 20 so as to prevent the wafer 20 from moving from a correct position on the holding member 50. An inner diameter of the template 50 defined to fit the wafer 20 therein. A thickness of the template 52 is about ⅔ of a thickness of the wafer 20. Note that, the template 52 may be detachably attached to the holding member 50.

A concave section 53 is opened downwardly. An elastic ring plate 54 is made from hard rubber. An outer edge of the elastic ring plate 54 is fixed on an outer edge of a ceiling face of the concave section 53; an inner edge of the elastic ring plate 54 is fixed on an upper face of the holding member 50. With this structure, the holding member 50 is suspended, and the holding member 50 is slightly movable in the vertical direction and the horizontal direction.

A pressurizing chamber 55 is formed in an inner space of the concave section 53 by the holding member 50 and the elastic ring plate 54. Pressurized fluid is supplied into the pressurizing chamber 55 from a fluid supplying system (not shown).

A main shaft 62 has a cylindrical shape. There is formed a tube 64, which is connected with the fluid supplying system, e.g., a compressor for supplying compressed air, in the main shaft 62. The tube 64 is connected with the pressurizing chamber 55. If the compressed air (the pressurized fluid) is supplied into the pressurizing chamber 55 when the lower surface of the wafer 20 is contacted the polishing face 10*a* of the polishing plate 10, the compressed air uniformly presses the whole upper face of the holding member 50. By uniformly pressing the holding member 50, the whole lower face of the wafer 20 is uniformly pressed onto the polishing face 10*a* of the polishing plate 10 with the desired force. Since the pressurized fluid (the compressed air in the embodiment) is supplied into the pressurizing chamber 55, the whole face of the holding member 50 is uniformly pressed, and the lower face of the wafer 20 is easily and properly fitted onto the polishing face 10*a* even if the polishing face 10*a* is inclined.

A base member 66 is moved so as to feed the wafer 20, which is held by the holding member 50, onto the polishing face 10*a* and to discharge the wafer 20 therefrom. The base 66 supports a wafer holding section 42, which is fixed to a lower end of the main shaft 62, and allows the wafer holding section 42 to rotate together with the main shaft 62.

An engaging section 68 is formed in an upper section of the main shaft 62, and its outer diameter is less than outer diameter of a main part of the main shaft 62. The engaging section 62 engages with bearings 76 of an arm section 74 of a rod 72 of a cylinder unit 70. The main shaft 62, which is integrated with the wafer holding section 42, is passed through a rotary transmitter 80, which is capable of rotating, with respect to the base member 66, with bearings 78. The bearings 78 are fixed in a cylindrical section 82, which is fixed to the base member 66. A key 84, which is fixed to the main shaft 62, is keyed in a key groove 81, which is formed in the rotary transmitter 80, so that the main shaft 62 rotates together with the rotary transmitter 80. Since the key groove 81 is formed in the longitudinal direction, the main shaft 62 is vertically movable, with respect to the base member 66 over a prescribed range by the cylinder unit 70. Note that, FIG. 3 shows the state in which the wafer holding section 42 is moved to the uppermost position by the cylinder unit 70.

A motor 86 rotates the rotary transmitter 80. The motor 86 rotates an output gear 88, which is engaged with a driven gear 90. The rotary transmitter 80 is keyed with the driven gear 90, so that the motor 86 rotates the rotary transmitter 80. The rotary transmitter 80 is capable of rotating, with respect to the base member 66, on the bearings 78.

The distributing section 92 acts as a connecting means for connecting with the compressor. The distributing section 92 rotatably holds an upper end section 62*a* of the main shaft 62, which is inserted in the distributing section 92. An air path is connected with the tube 64. A ring chamber 97 is formed between sealing members 96. An air-port 98 is connected with the ring chamber 97. With this structure, the compressor is always connected with the pressurizing chamber 55 via the air-port 98, the ring chamber 97, the air path 94 and the tube 64 even when the upper end section 62*a* is rotated.

An encoder 100 detects a rotational position of the main shaft 62 so as to stop the rotation of the wafer holding section 42 at a predetermined position.

Successively, the action of the polishing machine will be explained.

An abradant, e.g., slurry, is supplied onto the polishing face 10*a*. The wafer 20, which is held on the bottom face of the holding member 50, is pressed onto the polishing face 10*a* with predetermined force. The wafer 20 is relatively moved with respect to the polishing plate 10, so that the lower face of the wafer 20 is polished.

While polishing the wafer 20, the polishing plate 10 is rotated, and the polishing plate 10 is simultaneously moved by the circular orbital movement of the supporting table 22, which is the movement along the circular orbit without rotating about the supporting table's axis. On the other hand, the pressing mechanism 40 rotates the wafer 20 together with the wafer holding section 42.

By the circular orbital movement, all points on the polishing plate 10 execute the same movement, so all points on the lower face of the wafer 20 are uniformly polished with higher polishing accuracy. In the conventional polishing machine, flatness of an eight-inch silicon wafer is, for example, 0.5 $\mu$m; in the present embodiment, the flatness is improved to at or less than 0.2 $\mu$m. By uniformly polishing the wafers, the polishing member, e.g., the polishing cloth, is abraded uniformly, so the wafers can be polished under the same condition without adjusting the polishing condition, which is caused by uneven abrasion of the polishing member.

Note that, all points on the polishing plate 10 can execute the same movement by swinging the supporting table 22, but the moving speed of the supporting table 22 must be changed at turning points of the swing movement. So the swing movement is not as smooth as the circular orbital movement of the present embodiment. Thus, the flatness of the wafers, which are polished by the conventional polishing machine, cannot be higher.

Next, the polishing step of the present embodiment will be explained.

Firstly, the wafer holding section 42 is downwardly moved toward the wafer 20, which has been located at the prescribed position, by the cylinder unit 70, then the wafer 20 is held on the bottom face of the holding member 50 by the surface tension of the water.

Next, the base member 66 is moved to convey the wafer 20 to a position above the polishing plate 10. Then, the lower face of the wafer 20 is made to contact the polishing face 10*a* of the polishing plate 10 by moving the wafer holding section 52 downward by the cylinder unit 70.

The compressed air is introduced into the pressurizing chamber 55 so as to uniformly press the lower face of the wafer 20 onto the polishing face 10*a* with desired force. The compressed air is a fluid, so it can uniformly press the whole face of the holding member 50, and the lower face of the silicon wafer 20 is fitted to the polishing face 10*a* even if the polishing face 10*a* is inclined with respect to the lower face of the silicon wafer 20.

By uniformly pressing the whole upper face of the holding member 50, the lower face of the silicon wafer 20 is uniformly pressed onto the polishing face 10*a* even if the polishing face 10*a* is inclined.

The silicon wafer 20 is pressed onto the polishing face 10*a*, the slurry is supplied onto the polishing face 10*a*, and the wafer 20 and the polishing plate 10 are relatively moved, so that the lower face of the wafer 20 is polished like a surface of a mirror.

In the present embodiment, the holding member 50 comprises the ceramic plate and the elastic member. Since the coefficient of linear expansion of ceramics is less than that of metals, the wafer 20 can be uniformly polished with high polishing accuracy by the polishing machine of the present embodiment. However, the orbital driving mechanism of the present invention may be applied to the polishing machine having the holding member including a metal plate.

The holding member 50 may be not only the non-deformable plate but also an elastic film. Any member which is capable of uniformly pressing the wafer 20 onto the polishing face 10*a* can be employed as the holding member.

In the present embodiment, the wafer 20 is stuck onto the holding member 50 of the wafer holding section 42 by the surface tension of the liquid, e.g., the water. The wafer holding section 42 may attract and hold the wafer 20 so as to feed and discharge the wafer 20; the wafer holding section 42 may press the wafer 20 onto the polishing face 10*a* without attracting the wafer 20 while polishing.

In the present embodiment, the compressed air presses the wafer 20 onto the polishing face 10*a*. Other fluids, e.g., oil, water, may be employed to press the wafer 20 onto the polishing face 10*a*.

In the case of having a large sized holding member 50 which is capable of holding a plurality of wafers 20, the template has a plurality of the holes in each of which the wafer 20 can be fitted, so a plurality of the wafers 20 can be polished simultaneously.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine for polishing a wafer, comprising:

a polishing plate having a polishing face for polishing a surface of said wafer;

a supporting table rotatably supporting said polishing plate about a plate axis thereof;

a rotary driving mechanism, mounted on said supporting table, for rotating said polishing plate about said plate axis;

a base;

an orbital driving mechanism for moving said supporting table, with respect to said base, along a circular orbit in a plane parallel to the polishing face without spinning said support table about its own axis;

a pressing mechanism for holding said wafer and pressing said wafer onto the polishing face; and a rotating mechanism for rotating said wafer.

2. The polishing machine according to claim 1, wherein said orbital driving mechanism includes:

at least three arms each having a crank shape including:

a first shaft rotatably mounted in said base to rotate about a first shaft axis parallel to said plate axis of said polishing plate; and a second shaft rotatably mounted in said supporting table to rotate about a second shaft axis parallel to said first shaft axis, said second shaft axis being offset a prescribed distance away from said first shaft axis; and means for synchronously rotating said arms via said first shafts to move said polishing plate along said circular orbit.

3. The polishing machine according to claim 1, wherein said rotary driving mechanism includes:

a motor mounted to said supporting table and having an output shaft;

a worm gear coupled to said output shaft of said motor; and a worm wheel engaging said worm gear and coupled to said polishing plate to rotate said polishing plate about said plate axis.

4. The polishing machine according to claim 2, wherein said means for synchronously driving includes a motor coupled to each of said first shafts of said at least three arms and mounted to said base.

5. The polishing machine according to claim 1, wherein said polishing plate is removably mounted to said rotary driving mechanism.

6. The polishing machine according to claim 1, wherein said polishing plate is attached to said rotary driving mechanism by vacuum pressure.

* * * * *